US006662512B2

(12) United States Patent
Westphal

(10) Patent No.: US 6,662,512 B2
(45) Date of Patent: Dec. 16, 2003

(54) TWO-PIECE MULLION REINFORCEMENT

(75) Inventor: Dennis C. Westphal, Parma, MI (US)

(73) Assignee: CertainTeed Corporation, Valley Forge, PA (US)

( * ) Notice: Subject to any disclaimer, the term of this patent is extended or adjusted under 35 U.S.C. 154(b) by 23 days.

(21) Appl. No.: 10/068,657

(22) Filed: Feb. 6, 2002

(65) Prior Publication Data

US 2002/0092248 A1 Jul. 18, 2002

Related U.S. Application Data

(63) Continuation-in-part of application No. 09/607,762, filed on Jun. 30, 2000, now Pat. No. 6,360,498.

(51) Int. Cl.[7] ..... E06B 3/00; E06B 1/04; E06B 3/964; E04C 2/38; E04C 3/30

(52) U.S. Cl. ..... 52/204.5; 52/204.1; 52/204.62; 52/656.5; 52/730.3

(58) Field of Search ..... 52/466, 468, 582.1, 52/235, 204.5, 204.1, 204.62, 656.5, 730.3, 734.1

(56) References Cited

U.S. PATENT DOCUMENTS

| | | | | | |
|---|---|---|---|---|---|
| 3,057,444 | A | * | 10/1962 | Walberg | 52/461 |
| 3,082,849 | A | * | 3/1963 | Keller | 52/475.1 |
| 3,380,210 | A | * | 4/1968 | Neal | 52/235 |
| 3,665,666 | A | * | 5/1972 | Delcroix | 52/461 |
| 4,067,155 | A | * | 1/1978 | Ruff et al. | 52/105 |
| 4,207,717 | A | | 6/1980 | Hubbard | 52/235 |
| 4,648,231 | A | * | 3/1987 | Laroche | 52/775 |
| 4,738,065 | A | | 4/1988 | Crandell | 52/235 |
| 4,809,475 | A | | 3/1989 | Emmer | 52/235 |
| 4,981,001 | A | | 1/1991 | Furuminato | 52/235 |
| 5,007,221 | A | * | 4/1991 | Matthews et al. | 52/464 |
| 5,083,405 | A | | 1/1992 | Miller | 52/235 |
| 5,094,051 | A | | 3/1992 | Miller | 52/235 |
| 5,355,645 | A | | 10/1994 | Farag | 52/235 |
| 5,435,106 | A | | 7/1995 | Garries et al. | 52/204.5 |
| 5,444,958 | A | | 8/1995 | Lu | 52/775 |
| 5,579,616 | A | | 12/1996 | Farag | 52/235 |
| 5,632,125 | A | | 5/1997 | Osanai | 52/235 |
| 5,655,346 | A | * | 8/1997 | Holmes et al. | 52/476 |
| 5,678,383 | A | * | 10/1997 | Danielewicz | 52/775 |
| 5,937,597 | A | | 8/1999 | Sono et al. | 52/204.1 |
| 6,014,846 | A | | 1/2000 | Sono et al. | 52/204.1 |
| 6,360,498 | B1 | * | 3/2002 | Westphal | 52/204.5 |

* cited by examiner

*Primary Examiner*—Carl D. Friedman
*Assistant Examiner*—Kevin McDermott
(74) *Attorney, Agent, or Firm*—Duane Morris LLP

(57) ABSTRACT

A mullion reinforcement is provided comprising a first member that is fastenable to a portion of a first window frame. It includes at least one pilot that is formed on a surface of the first member, a first portion of a latch, and a first portion of a catch. A second member is also provided that is fastenable to a portion of a second window frame. It includes at least one pilot receptacle formed on a surface of the second member, and is engagable with the at least one pilot when the first window frame is assembled to the second window frame. The second member includes a second portion of a latch and a second portion of a catch that are complementary to the first portion of a latch and the first portion of a catch. When the first window frame is assembled to the second window frame, the first member and the second member cooperate to form a latch and a catch.

20 Claims, 14 Drawing Sheets

TWO-PIECE MULLION REINFORCEMENT

This is a continuation-in-part of copending patent application Ser. No. 09/607,762, titled TWO-PIECE MULLION REINFORCEMENT, filed Jun. 30, 2000, and now issued as U.S. Pat. No. 6,360,498.

FIELD OF THE INVENTION

The present invention generally relates to window assemblies, and more particularly to a reinforcing mullion that enhances structural rigidity while allowing for field construction of multiple window assemblies.

BACKGROUND OF THE INVENTION

Window frames traditionally have been made from wood or metal or various combinations of wood and metal. In recent years, windows formed with hollow metal or polymer frames have become popular, due to their improved thermal properties, lower cost and relative ease of manufacture, assembly and installation compared with traditional wood and metal windows. Such window assemblies may be limited in size by the requirement that they withstand design wind-loads as established by local building codes and ordinances. Another factor limiting the allowable size of multiple window assemblies is the fact that such assemblies are very often difficult to transport, handle, and install.

Windows made from various combinations of polymer and metal components are known in the prior art. For example, U.S. Pat. No. 5,435,106 discloses a window assembly including adjacent first and second windows and a reinforcing mullion connecting the windows. The mullion comprises hollow polymeric first and second lineals and a single metal reinforcing bar fastened between the lineals. Interior and exterior face caps that are attached to the lineals span a gap between them. A steel plate, two high strength steel bolts or posts, and several wood screws are provided for connecting an end portion of the metal reinforcing bar to a support structure surrounding the window opening in the building. The mullion adds rigidity to the assembly, thereby allowing for an increase in its allowable size. Various other prior art designs have also provided similar structures to add rigidity to a window assembly, e.g., U.S. Pat. Nos.: 6,014,846; 5,937,597; and 4,981,001.

These and other prior art windows generally suffer from one or more disadvantages making them less than entirely suitable. For example, as windows of these types are arranged in multiple window assemblies, the assemblies become quite large and heavy. As a result, these prior art window assemblies are difficult to handle, and often do not lend themselves to field installation. Accordingly, there is a need to provide windows with field assemblable reinforcements so that they are able to meet design standards economically, when several such windows are combined into a unitary assembly, and to be easily and economically assembled together in the field or factory.

SUMMARY OF THE INVENTION

The present invention provides a two-piece mullion reinforcement for use in forming an assembly of windows. In one embodiment, a first member that is fastenable to a portion of a first window frame, includes at least one piloting tab that extends along and projects outwardly from a surface of the first member. A second member that is likewise fastenable to a portion of a second window frame, includes at least one pilot receptacle that is formed on a surface of the second member. Advantageously, the pilot tab and pilot receptacle comprise mutually complementary profiles so as to be engagable with one another when the first window frame is assembled to the second window frame. In another embodiment, the first member includes a first portion of at least one latch and the second member includes a second portion of the at least one latch that is complementary to the first portion so that when the first window frame is assembled to the second window frame the first member and the second member cooperate to form at least one latch. A window assembly is also provide including adjacent first and second windows each having a frame and being connected by a two-piece mullion reinforcement according to the invention.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
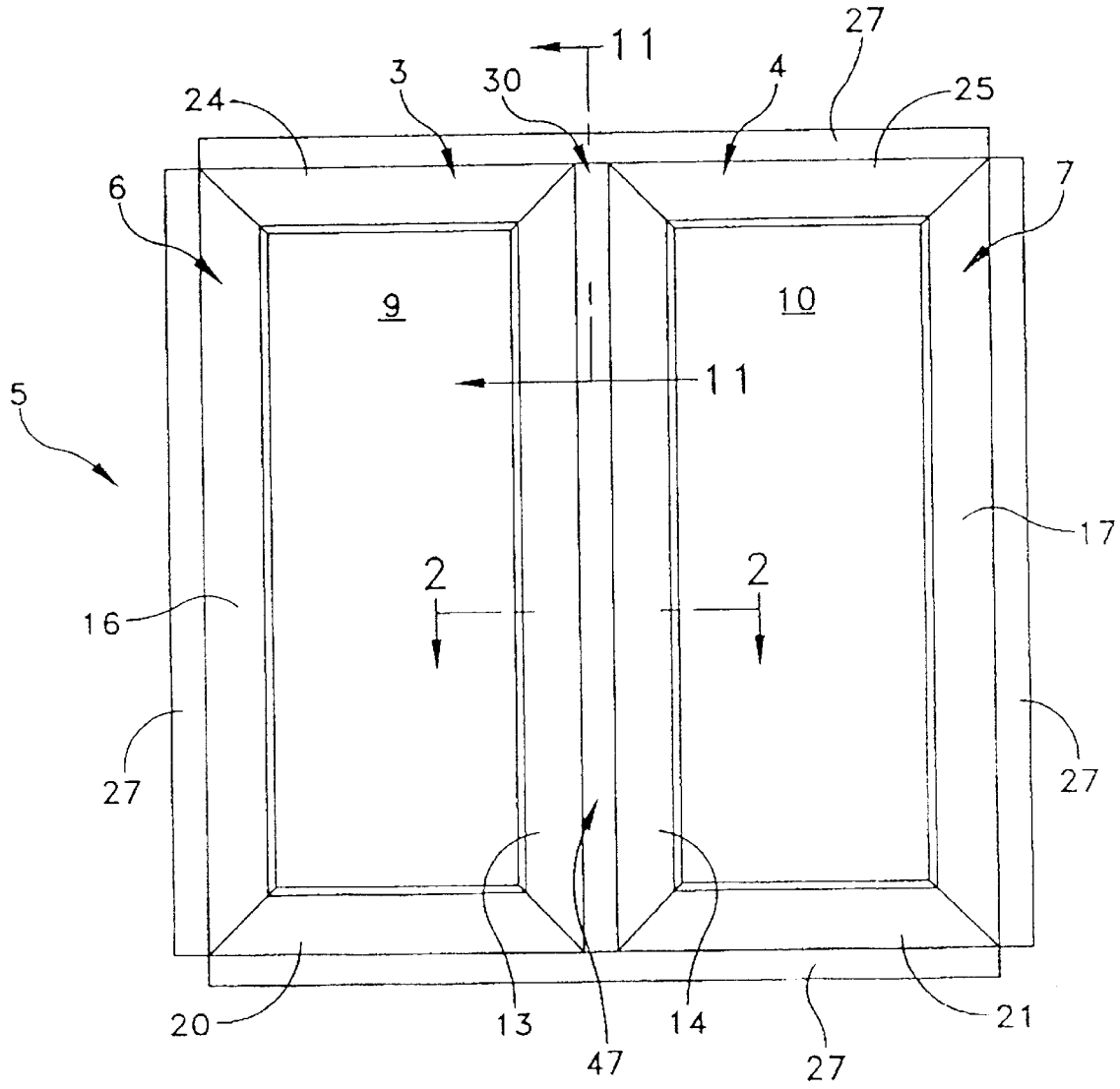
FIG. 1 is a front elevational view of a window assembly made in accordance with the present invention viewed from the interior of a building.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses are intended to cover the structures described, suggested, or rendered obvious by the written description or drawings for performing the recited function, including not only structural equivalents but also equivalent structures.

Referring to FIG. 1, the windows forming a portion of the assemblies discussed in this detailed description are often made up of two or more adjacent discrete windows, and are preferably generally rectangular, with each including elongated stiles, a sill and a rail. Frames of the windows are preferably made from hollow, rigid extrusions that are formed from light weight metals or polymers. For example, window assembly 5 includes two laterally adjacent window units 3,4 having hollow frames 6,7 supporting glass window panes 9,10, respectively. Frames 6,7 include inner jambs 13,14 and outer jambs 16,17 both connecting bottom sills 20,21 to heads or rails 24,25, respectively. Frames 6,7 may also include a nailing flange 27. A centrally located mullion 30 interconnects frames 6,7 to form window assembly 5, and to improve structural rigidity.

It will be understood that the present invention is in no way limited to a two window assembly, and may be advantageously used in multiple window assemblies. Also, the two-piece mullion reinforcement of the present invention is suitable for use with other types of window assemblies, including but not limited to, sliding sash windows, picture windows, awning windows, jalousie windows, tilt and turn windows and patio doors of all types.

Figure 6:
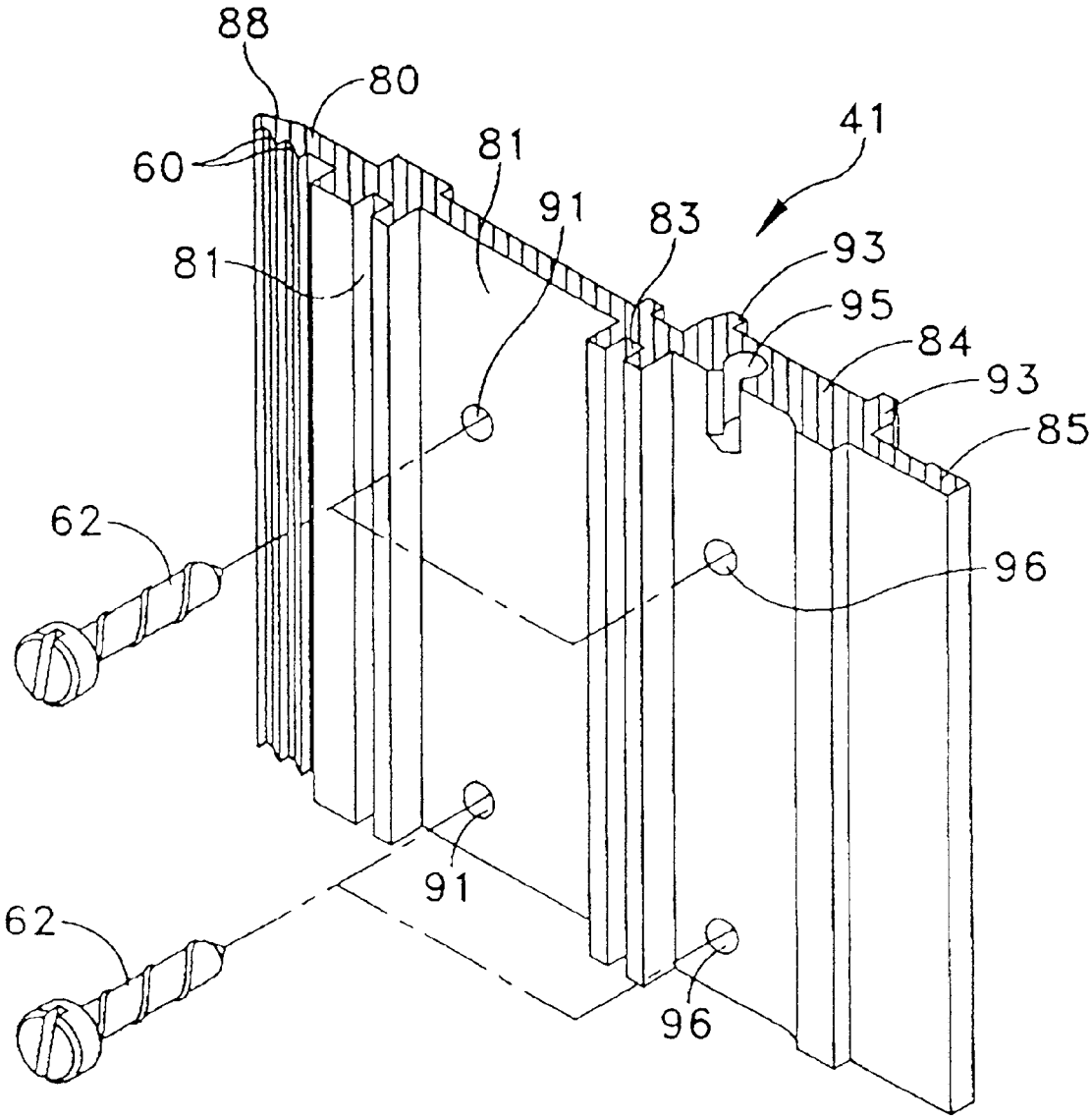
FIG. 6 is a perspective view of female reinforcement member.

Referring now to FIGS. 2–5 and 9–10, the present invention provides a field mulling apparatus comprising a male mullion reinforcement member 40 (FIG. 5) and a female mullion reinforcement member 41 (FIG. 6). The two mullion reinforcement members 40,41 are adapted to be mounted upon a portion of inner jamb 13,14 of frames 6,7 so as to allow for the field construction of window assembly 5, and to securely hold a thermal barrier 42, an exterior cover 43, and an interior cover 47 in place at the junction between windows 3,4. More particularly, mullion reinforcement members 40,41 are each elongate plank-like structural elements, having a selectively formed transverse cross-sectional profile (best seen in FIGS. 3, 5 and 6). Preferably, mullion reinforcement members 40,41 comprise a metal, such as an aluminum alloy or steel, or a combination of aluminum alloy and steel, or may comprise other metals, a structural polymer, or a fiber glass or carbon fiber reinforced composite material of the type well known in the art. Each mullion reinforcement member 40,41 has a length that is at least similar to the length of inner jambs 13,14 or outer jambs 16,17 of frames 6,7. Mullion reinforcement members 40,41 are often extruded in over-sized lengths, e.g., fourteen foot lengths, and cut down to fit a wide variety of windows.

Figure 3:
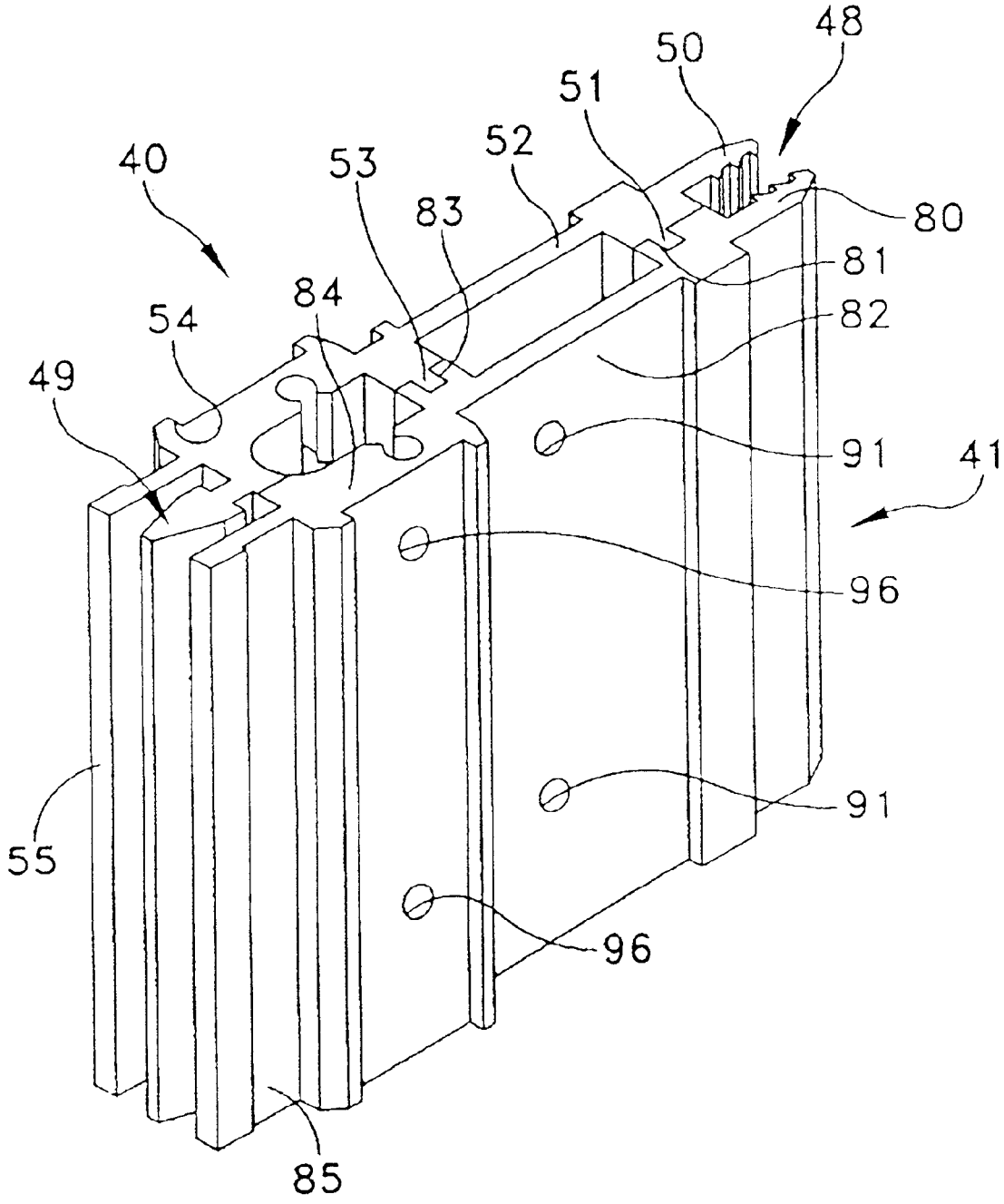
FIG. 3 is a broken-away perspective view of the two-piece mullion reinforcement of the present invention, as assembled, but with the window frame removed for clarity of illustration.
Figure 4:
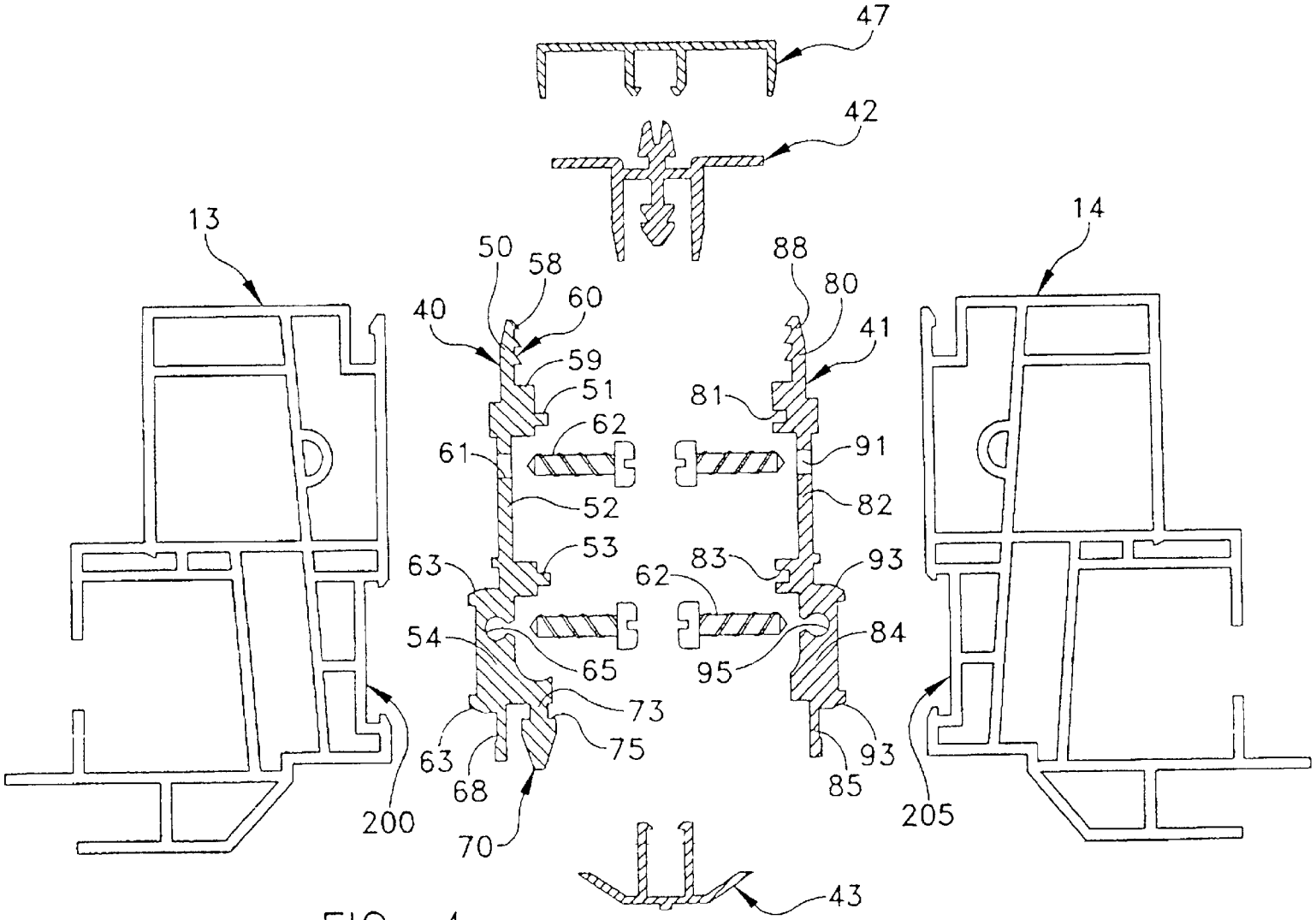
FIG. 4 is an exploded and enlarged top view of the cross-section of the two-piece mullion reinforcement shown in FIG. 2.
Figure 5:
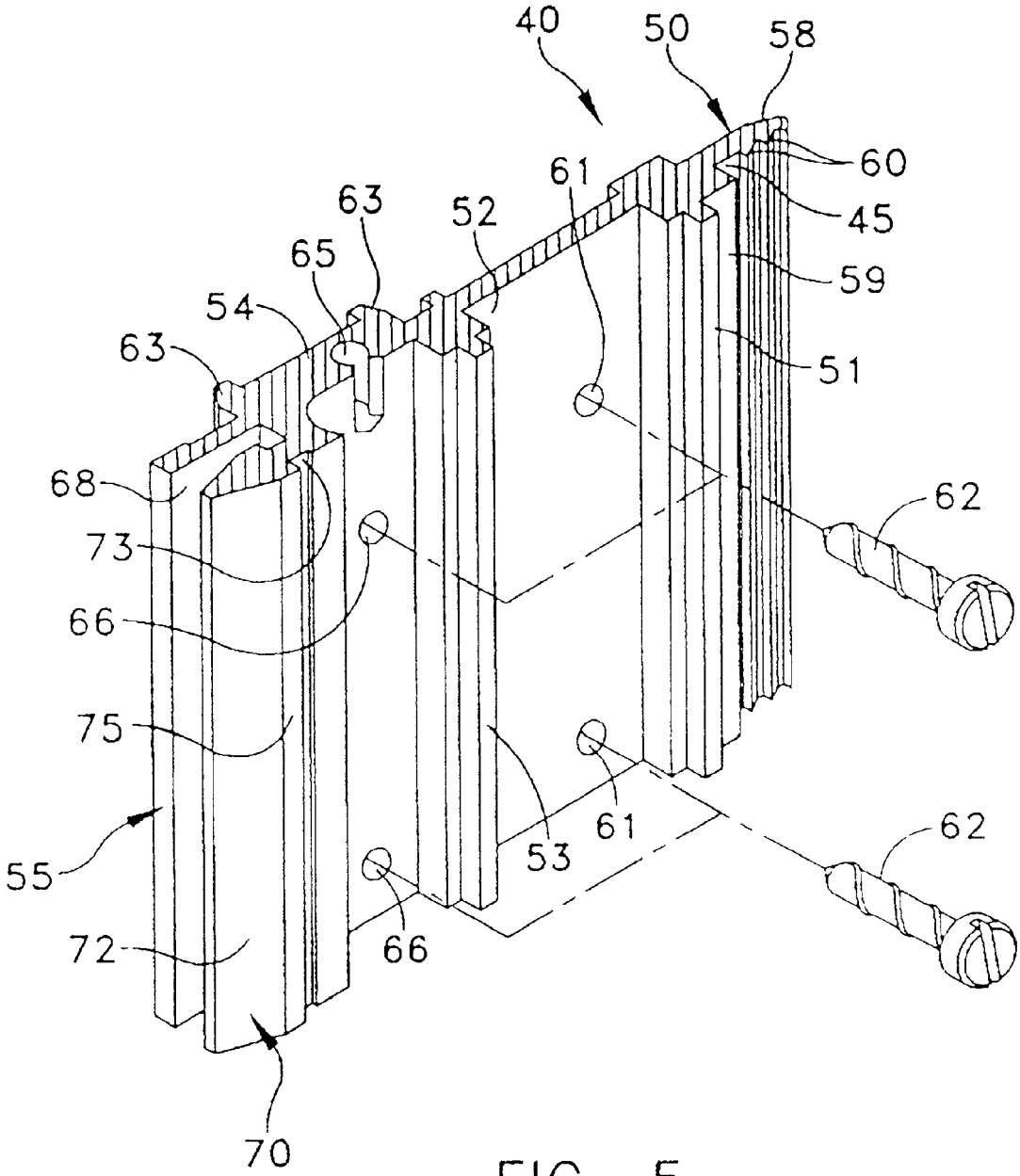
FIG. 5 is a perspective view of male reinforcement member.

Referring to FIGS. 3 and 4, the transverse profile of male mullion reinforcement member 40 is formed to include a first half 50 of a thermal barrier latch 48, a first piloting tab 51, a central portion 52, a second piloting tab 53, a frame lock 54, and a first half 55 of an exterior cover latch 49. The first half 50 of thermal barrier latch 48 is essentially a cantilevered beam formed on a lateral edge of male mullion reinforcement member 40, that narrows to form a chamfered tip 58. Parallel rows of teeth 60 are formed on the inner side of first half 50 of thermal barrier latch 48, adjacent to chamfered tip 58, and extend toward a shoulder portion 59 that is formed in spaced relation to chamfered tip 58.

First piloting tab 51 and second piloting tab 53 project outwardly in substantially perpendicular relation to the inner side of male mullion reinforcement member 40, with central portion 52 positioned between them. First piloting tab 51 is positioned adjacent to shoulder 59 and second piloting tab 53 is positioned adjacent to frame lock 54. First and second piloting tabs 51,53 are substantially parallel to one another, and may have any one of a variety of cross-sectional shapes including rectilinear, polygonal, circular, elliptical, etc. Central portion 52 extends between first and second piloting tabs 51,53, and includes through-holes 61 that are sized to receive fastener 62, e.g., screws, nails, or the like.

Figure 15:
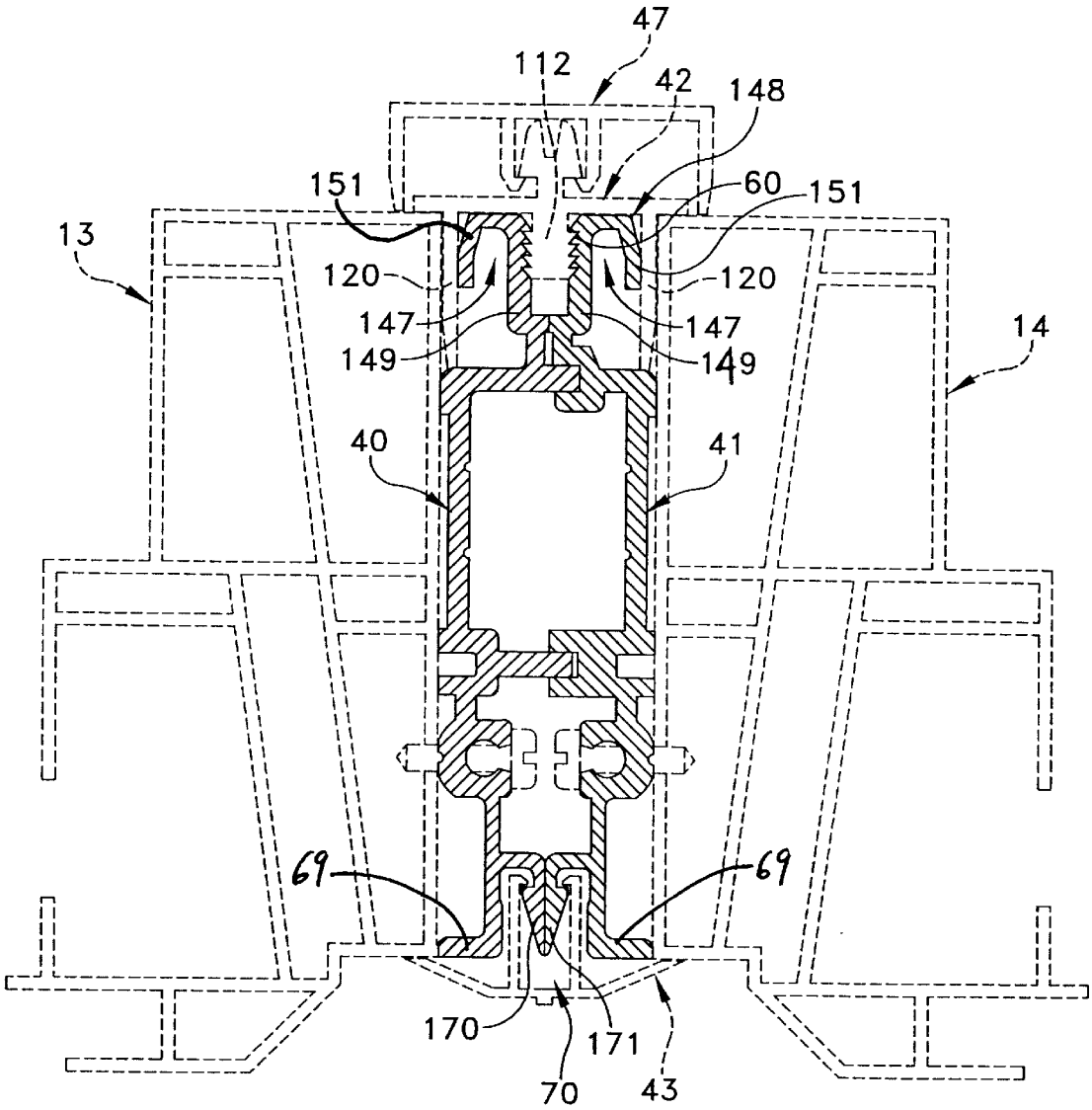

Frame lock 54 projects outwardly from an outer side of male mullion reinforcement member 40, and includes a pair of spaced apart feet 63 and a longitudinally oriented bore 65 that opens at a terminal end of male mullion reinforcement member 40. Second through-bores 66 are defined in frame lock 54, and communicate between the inner side and the outer side of male mullion reinforcement member 40. First half 55 of exterior cover latch 49 projects from a side surface of frame lock 54 and includes a locking beam 68 and a catch 70. Locking beam 68 comprises a cantilevered beam, which may include a locating leg 69 projecting outwardly from its free end (FIG. 15). Catch 70 preferably comprises a substantially triangular cross-sectional shape, including sloping surfaces 72. Of course, other cross-sectional shapes may be utilized as long as they provide structure for engaging exterior cover 43. A stem 73 projects from a portion of catch 70 so as to attach it to a portion of frame lock 54. In this way, a pair of shoulders 75 are formed adjacent to the sides of stem 73.

Referring to FIG. 6, the transverse profile of female mullion reinforcement member 41 is substantially similar to that of male mullion reinforcement member 40, and includes a second half 80 of thermal barrier latch 48, a first piloting tab receptacle 81, a central portion 82, a second piloting tab receptacle 83, a frame lock 84, and a second half 85 of exterior cover latch 49. More particularly, second half 80 of thermal barrier latch 48 is essentially a cantilevered beam formed on a lateral edge of female mullion reinforcement member 41, that narrows to form a chamfered tip 88, and is complementary to first half 50, i.e., completes the structure of thermal barrier latch 48. Parallel rows of teeth 90 are formed on the inner side of second half 80 of thermal barrier latch 48, adjacent to chambered tip 88, and extend toward a shoulder portion 89 that is formed in spaced relation to tip 88.

First piloting tab receptacle 81 and second piloting tab receptacle 83 open outwardly in substantially perpendicular relation to the inner side of female mullion reinforcement member 41, with central portion 82 positioned between them. First piloting tab receptacle 81 is positioned adjacent to shoulder 89 and second piloting tab receptacle 83 is positioned adjacent to frame lock 84. First and second piloting tab receptacles 81,83 are substantially parallel to one another, and may have any one of a variety of cross-sectional shapes including rectilinear, polygonal, circular, elliptical, etc., as long as their shape corresponds to, and is complementary to, the cross-sectional shape of first and second piloting tabs 51,53, respectively. Central portion 82 extends between first and second piloting tab receptacles 81,83, and includes through-holes 91 that are sized to receive fasteners 62.

Frame lock 84 projects outwardly from the outer side of female mullion reinforcement member 41, and includes a pair of spaced apart feet 93 and a longitudinally oriented bore 95 that opens at a terminal end of female mullion reinforcement member 41. Second through-bores 96 are defined in frame lock 84, and communicate between the inner side and the outer side of female mullion reinforcement member 41. Second half 85 of exterior cover latch 49 projects from a side surface of frame lock 84, comprises a cantilevered beam, and is complementary to first half 55, i.e., completes the structure of exterior latch 49.

Figure 7:
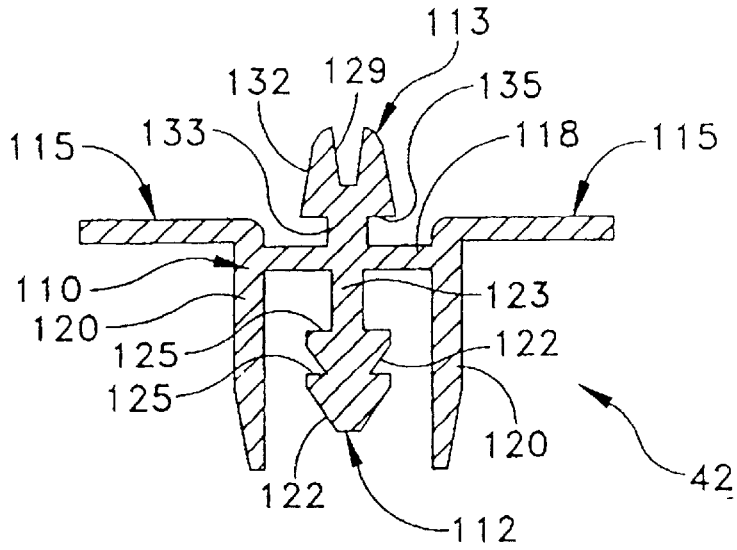
FIG. 7 is a top cross-sectional view of a thermal barrier lock.
Figure 8:
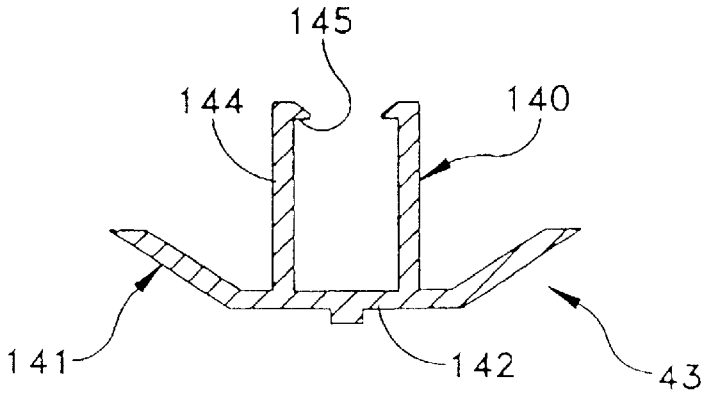
FIG. 8 is a top cross-sectional view of a cover.
Figure 9:
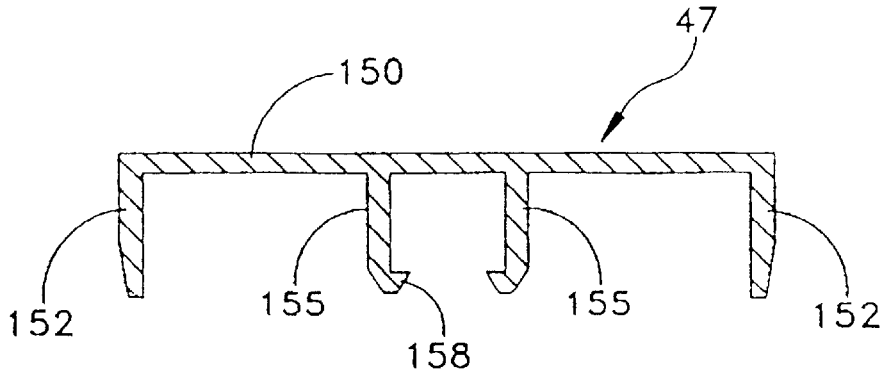
FIG. 9 is a top cross-sectional view of an exterior cover lock.

Referring to FIGS. 7, 8, and 9, to complete window assembly 5 thermal barrier 42, exterior cover 43, and interior cover 47 are mounted to mullion reinforcement members 40,41 and onto a portion of inner jamb 13,14 of frames 6,7. More particularly, thermal barrier 42 is an elongate structural element typically formed or extruded from one of the well known engineering polymers that are often used in the construction trade, e.g., polyvinyl chloride or similar compounds. Of course, thermal barrier 42 may be formed from fiber glass or carbon fiber reinforced composite materials or the like and of type well known in the art. When applied to window assembly 5, thermal barrier 42 has a length that is at least similar to the length of inner jambs 13,14 or outer jambs 16,17 of frames 6,7. When manufactured, thermal barrier 42 is often extruded in over-sized lengths, e.g., fourteen foot lengths, and cut down to fit a wide variety of windows.

Thermal barrier 42 includes an insulating channel 110, an inner catch 112, an outer catch 113, and insulating flanges 115. More particularly, insulating channel 110 comprises a web 118 and spaced apart flanges 120. Inner catch 112 projects from web 118 so as to be located between flanges 120, and has a substantially triangular cross-sectional shape, including sloping surfaces 122. A stem 123 projects from web 118 so as to attach inner catch 112 to insulating channel 110. In this way, at least a pair of shoulders 125 are formed adjacent to the sides of stem 123 and spaced away from web 118.

Outer catch 113 projects outwardly and away from web 118 and flanges 120, and also preferably has a substantially triangular or conical cross-sectional shape, including sloping outer surfaces 132. Of course, other cross-sectional shapes may be utilized as long as they provide structure for engaging interior cover 47. A central recess 129 is formed in outer catch 113 to provide for resilience when mating with a corresponding latch portion of interior cover 47. A stem 133 projects from web 118 so as to attach outer catch 113 to insulating channel 110. In this way, at least a pair of shoulders 135 are formed adjacent to the sides of stem 133 and spaced away from web 118. Insulating flanges 115 project outwardly from the intersection between web 118 and flanges 120 in substantially parallel relation to web 118.

Referring to FIGS. 8 and 9, exterior cover 43 includes an insulating channel 140 and insulating flanges 141. More particularly, insulating channel 140 comprises a web 142 and spaced apart flanges 144, wherein flanges 144 include inwardly projecting shoulder 145 positioned at their terminal ends. Insulating flanges 141 project outwardly from the intersection between web 142 and flanges 144, in sloping relation to web 142. Interior cover 47 comprises a channel-shaped cross-section having a web 150 and spaced apart flanges 152 positioned at the ends of web 150. A pair of spaced apart latching flanges 155 project outwardly from web 150 in substantially parallel relation to one another. Each latching flange 155 includes inwardly projecting shoulders 158 positioned at their terminal ends.

Figure 2:
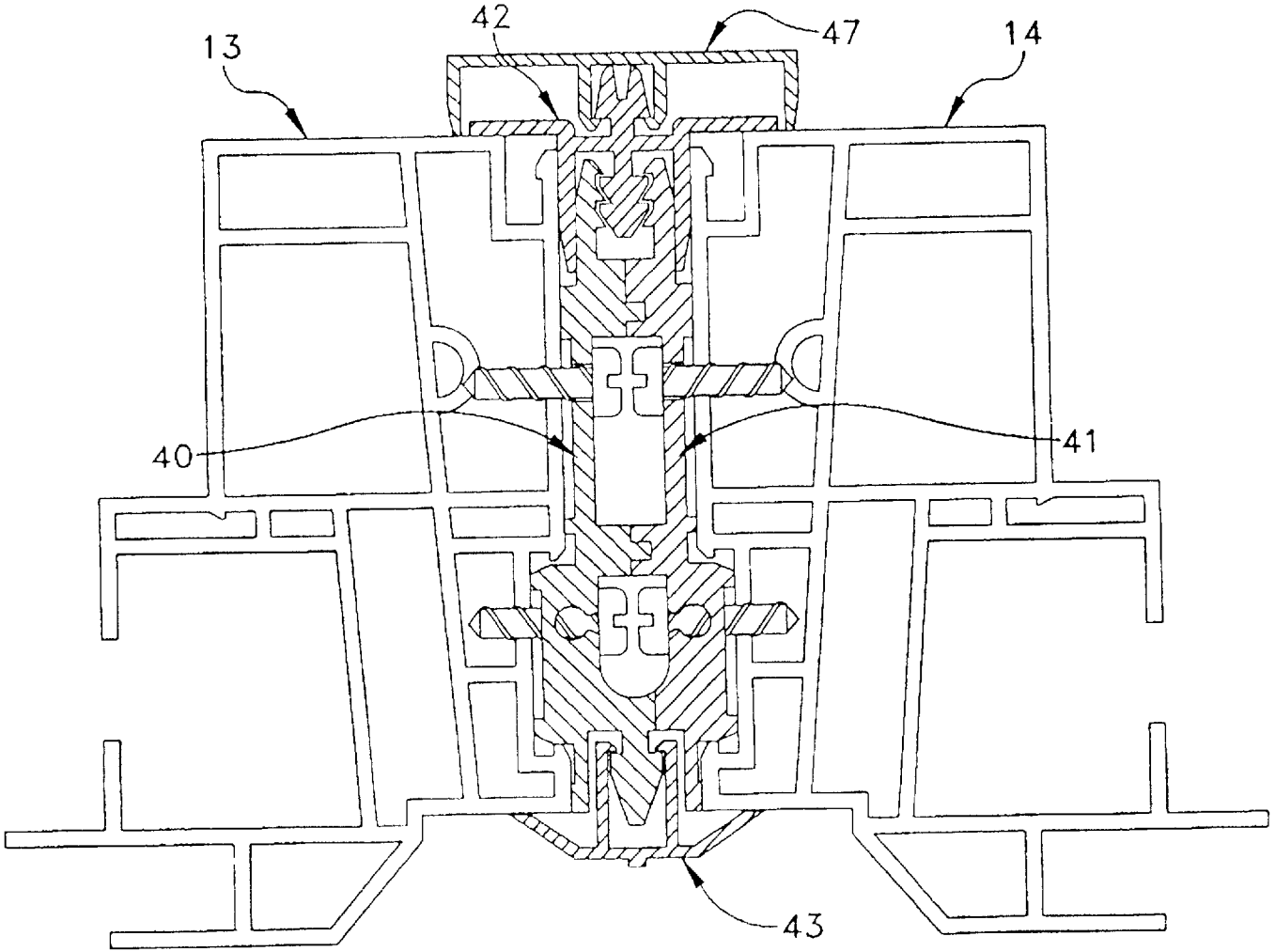
FIG. 2 is a top cross-sectional view of a two-piece mullion reinforcement formed according to the present invention, as taken along section line 2—2 in FIG. 1.
Figure 10:
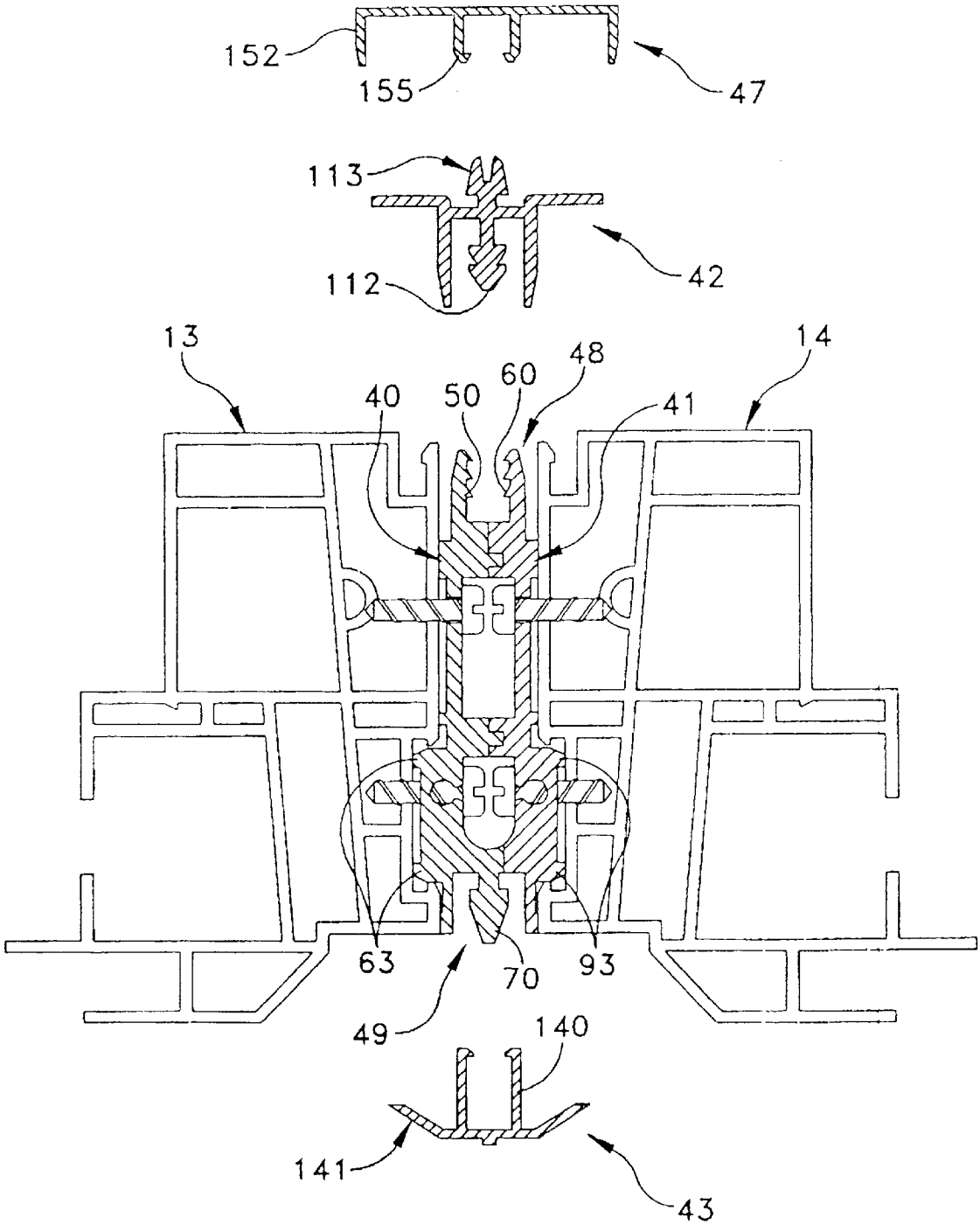
FIG. 10 is a top cross-sectional view, similar to that shown in FIG. 2, but showing the male and female mullion reinforcement members assembled to the frame and engaged with one another just prior to engagement of the inner and outer locks and cap.

The present invention is used to form a window assembly 5 in the following manner. Referring to FIGS. 2, 4, and 10, male and female mullion reinforcing members 40,41 are first fastened to corresponding portions of frames 13,14. More particularly, male mullion reinforcing member 40 is oriented so that frame lock 54 is positioned in confronting aligned relation to a corresponding recessed feature of frame 13 (shown generally at reference numeral 200 in the figures). Once in this position, male mullion reinforcement member 40 is moved toward frame 13 so that frame lock 54 enters recess 200 until feet 63 engage a portion of frame 13. Fasteners 62 are then inserted through bores 61 and 66 so as to fasten male mullion reinforcement member 40 to frame 13. A similar procedure is followed in attaching female mullion reinforcement member 41 to frame 14. More particularly, frame lock 84 is positioned in confronting aligned relation with corresponding recess 205 of frame 14, and female mullion reinforcement member 41 is moved toward frame 14 until feet 93 engage a portion of frame 14. Fasteners 62 are then positioned through bores 91 and 96 of female mullion reinforcement member 41 so as to attach it to frame 14. It should be noted that mullion reinforcement members 40,41 are designed such that they can be interchanged, left to right, as viewed in FIG. 4, without deviation from the present invention. It should also be noted that mullion reinforcement members 40,41 may be installed on frames 13,14 at the factory during a portion of the window manufacturing process or, at the construction site by the window assembly installers.

Once frames 13,14 have mullion reinforcement members 40,41 fastened to their side surfaces, a window assembly 5 may be formed. More particularly, frames 13,14 are aligned such that first and second piloting tabs 51,53 are in confronting aligned relation with first and second piloting tab receptacles 81,83. Once in this position, frames 13,14 are moved toward one another until first and second piloting tabs 51,53 are received within first and second piloting tab receptacles 81,83. This arrangement of pilots and pilot receptacles provides for proper registration and mating of adjacent individual windows so as to form a window assembly.

As mullion reinforcement members 40,41 are engaged, the complementary portions of thermal barrier latch 48 and exterior cover latch 49, that are formed on mullion reinforcement members 40,41, are positioned in latch completing relationship to one another so as to form latches 48 and 49 on window assembly 5.

Referring to FIG. 10, with male and female mullion reinforcement members 40, 41 engaged and forming a mullion between windows 3,4, thermal barrier 42, exterior cover 43, and interior cover 47 may be assembled to mullion reinforcement member 40,41 so as to complete window assembly 5. More particularly, thermal barrier 42 is oriented so that inner catch 112 is positioned in confronting aligned relation with thermal barrier latch 48. Once in this position, thermal barrier 42 is moved toward window assembly 5 so that inner catch 112 moves between first and second halves 50,80 of thermal barrier latch 48. As this occurs, teeth 60 engage shoulders 125 so as to firmly retain thermal barrier 42 on mullion reinforcement members 40,41. At the same time, flanges 120 slip between first and second halves 50,80 and a portion of frames 13,14 so as to isolate mullion reinforcement members 40,41 from frames 13,14. Flanges 115 of thermal barrier 42 engage the outer surfaces of frames 13,14 once inner catch 112 is fully engaged by thermal barrier latch 48. It will be understood that thermal barrier 42 provides the required insulative barrier between the intersection of windows 3,4 and the surrounding environment.

With thermal barrier 42 in place and engaged with mullion reinforcement members 40, 41, interior cover 47 may be fastened to thermal barrier 42. More particularly, interior cover 47 is first oriented so that latching flanges 155 are positioned in confronting aligned relation with outer catch 113 and thermal barrier 42. Once in this position, interior cover 47 is moved toward thermal barrier 42 until shoulders 158 of flanges 155 engage shoulders 135 of outer catch 113 so as to firmly fasten interior cover 47 to thermal barrier 42. Exterior cover 43 is similarly fastened to exterior cover latch 49 by positioning insulating channel 140 in confronting aligned relation with catch 70 of exterior latch 49. Once in this position, exterior cover 43 is moved toward catch 70 so that flanges 144 slide along surface 72 of catch 70 until shoulders 145 engage corresponding shoulder 75 of catch 70.

Figure 11:
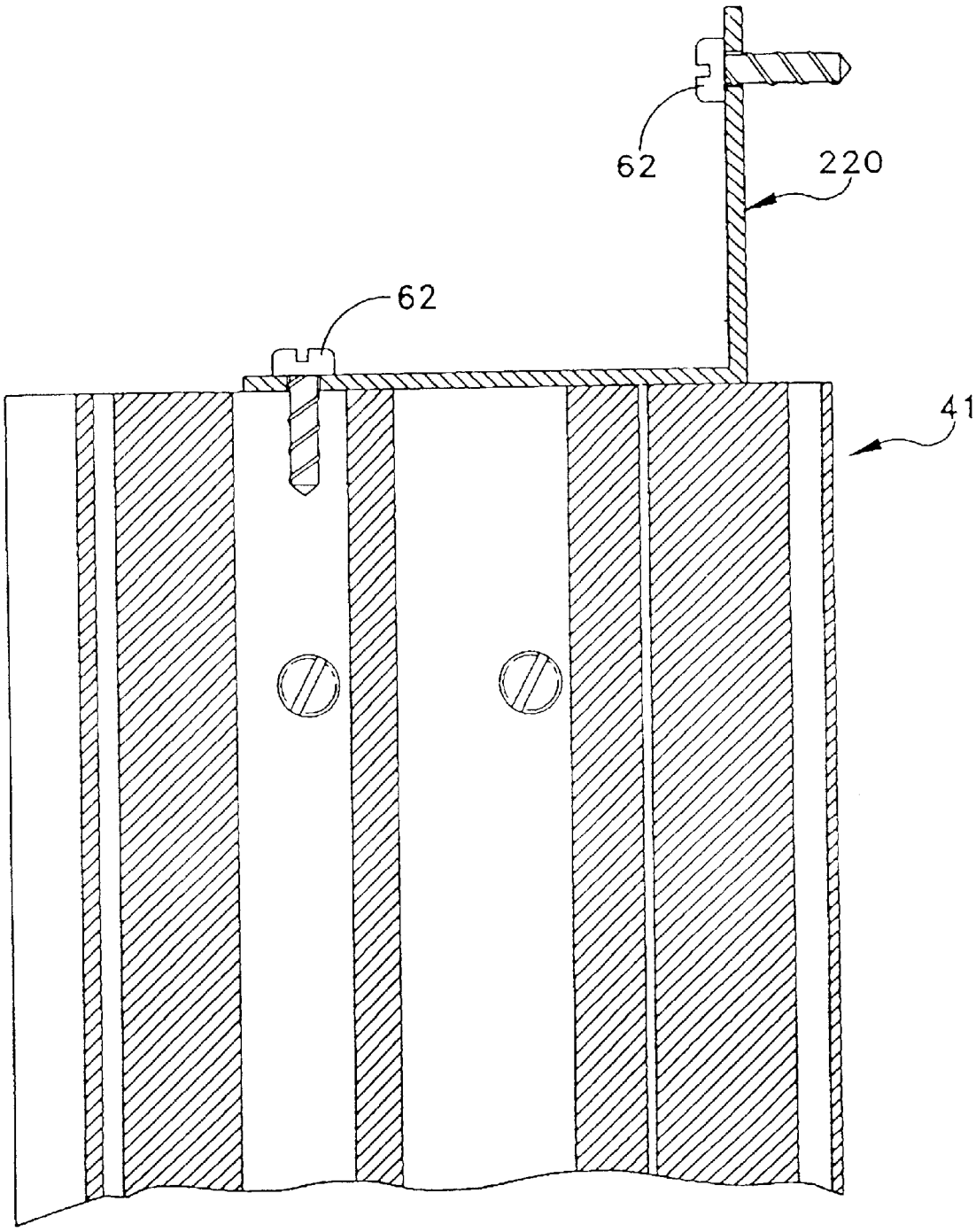
FIG. 11 is a side elevational view of the two-piece mullion reinforcement, as taken along section line 11—11 in FIG. 1, and showing a portion of an L-bracket in phantom.

Referring to FIG. 11, window assembly 5 is fastened to a portion of the building into which it is being installed by attaching a bracket 220 to either or both mullion reinforcement members 40,41, and inserting a fastener 62 through a corresponding hole in bracket 220 and engaging either of bores 65 or 95.

Figure 12:
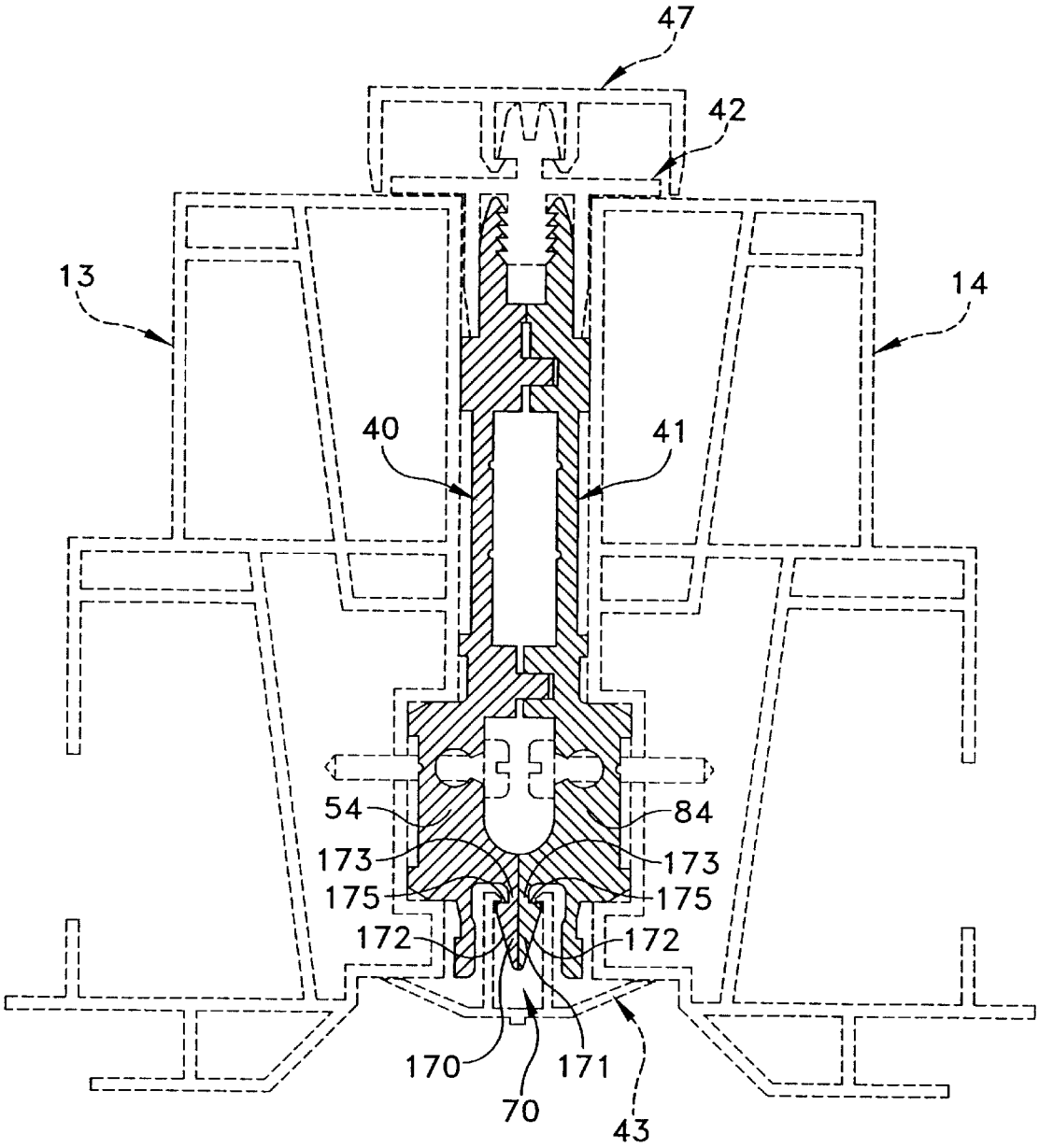
FIGS. 12–16 are each a top cross-sectional view, partially in phantom and similar in perspective to FIG. 2, of a variety of alternative two-piece mullion reinforcements formed according to the present invention.

Referring to FIGS. 12–16, the two-piece field mullion of the present invention may be modified in a number of ways without departing from the scope or spirit of the present invention. For example, catch 70 may be split into halves 170,171 that are formed on male mullion reinforcement member 40 and female mullion reinforcement member 41, respectively, as shown in FIG. 12. Halves 170,171 of male mullion reinforcement member 40 and female mullion reinforcement member 41 each comprise a substantially triangular cross-sectional shape, including sloping surfaces 172. Of course, other cross-sectional shapes may be utilized as long as they provide structure for engaging exterior cover 43. A stem 173 projects from a portion of each half 170,171 so as to attach each half to an inner portion of frame locks 54,84, respectively. In this way, a pair of shoulders 175 are formed adjacent to the sides of stems 173.

Figure 13:
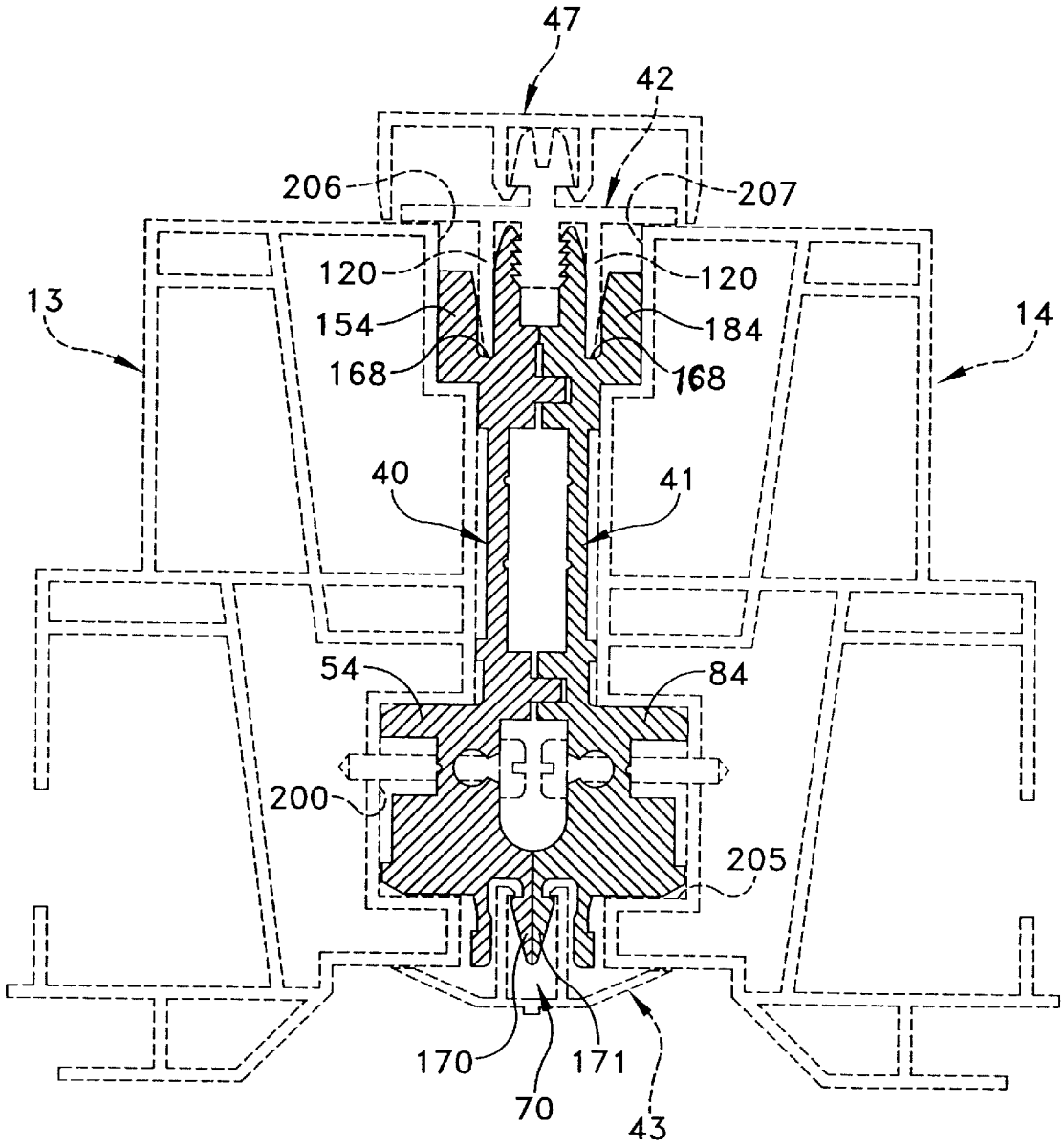
Figure 14:
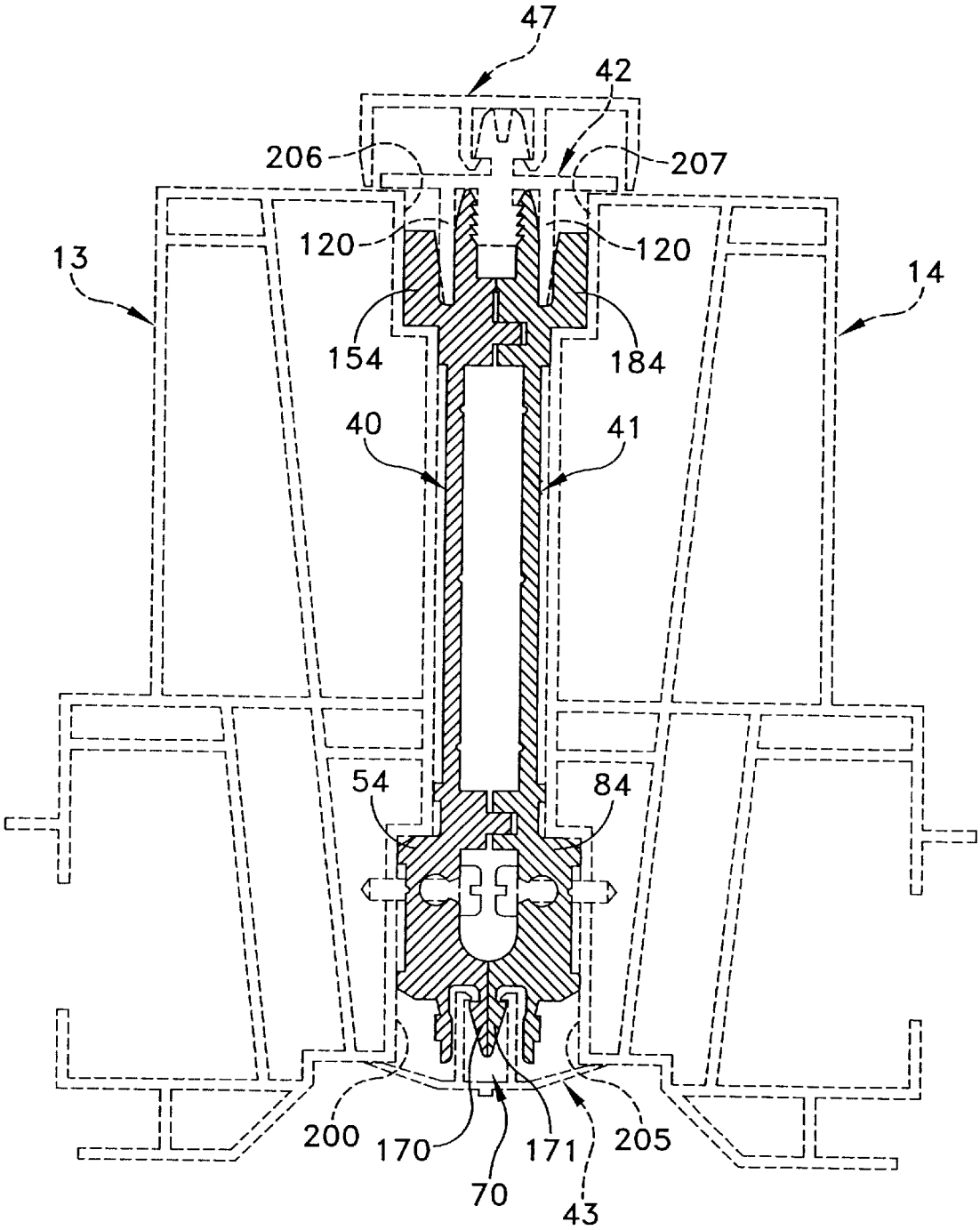

In addition, secondary frame locks 154,184 may be provided that project outwardly from the outer side of male mullion reinforcement member 40 and female mullion reinforcement member 41 (FIGS. 13 and 14). Secondary frame locks 154,184 may be used when frames 13,14 include upper recesses 206,207 in addition to lower recesses 200, 205. Frame locks 154,184 each define a recess 168 that is sized and shaped to accept spaced apart flanges 120 of thermal barrier 42.

Referring to FIG. 15, a pair of U-shaped catches 147 combine to form a thermal barrier latch 148 on the end of an assembled male mullion reinforcement member 40 and female mullion reinforcement member 41. Each U-shaped catch 147 comprises two cantilevered beams 149,151. Parallel rows of teeth 60 are formed on the inner side of each first cantilever 149 so as to be arranged in confronting spaced relation to one another. In this way, when inner catch 112 engages teeth 60, first cantilevers 149 deflect outwardly toward frames 13,14, respectively. Secondary cantilevers 151 extend from an end of each first cantilever 149 so that when thermal barrier 42 is mounted to thermal barrier latch 148, spaced apart flanges 120 engage and deflect secondary cantilevers 151 so as to provide further sealing engagement between thermal barrier 42, frames 13,14, and male mullion reinforcement member 40 and female mullion reinforcement member 41.

Figure 16:
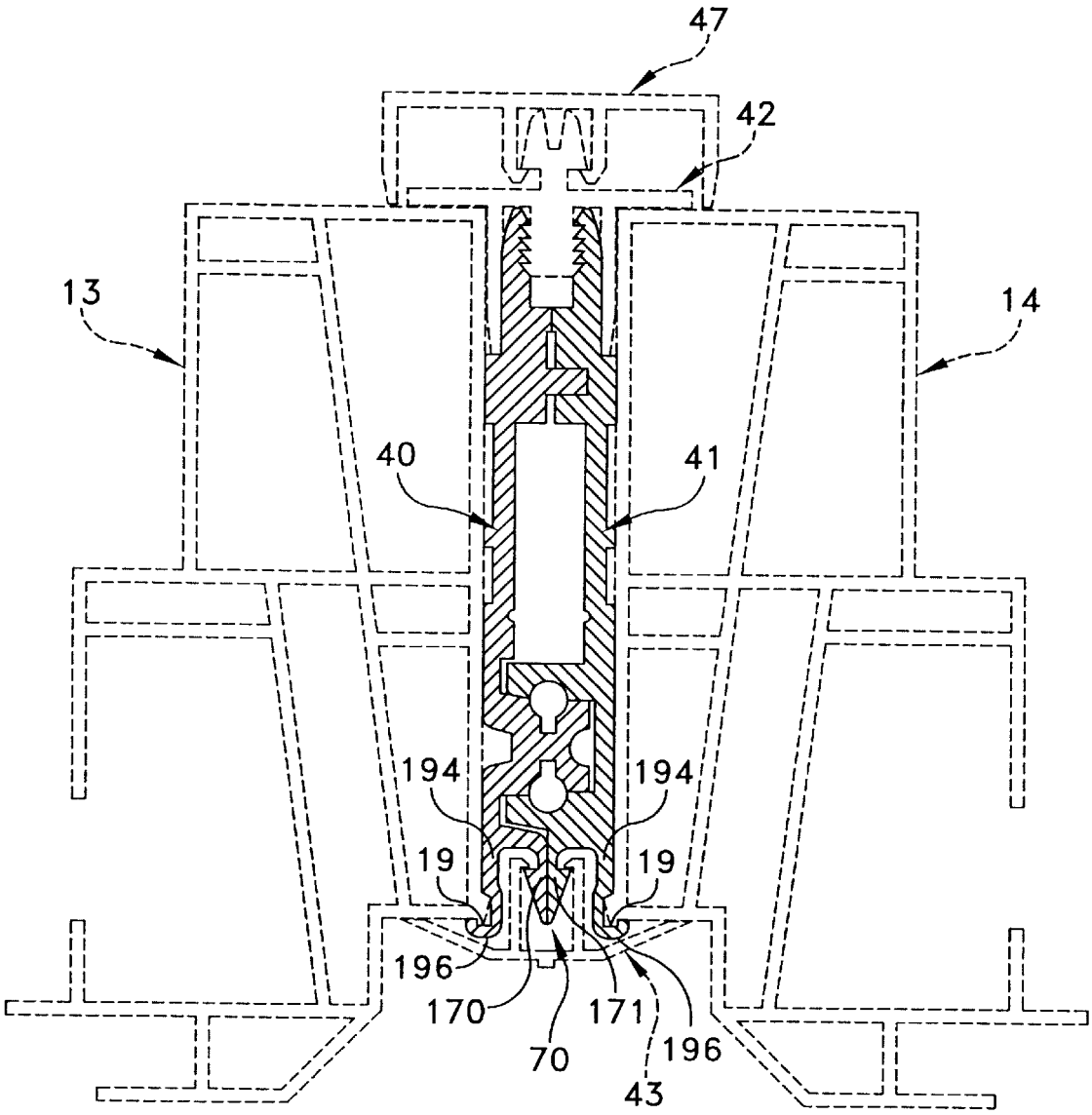

Referring to FIG. 16, in some windows recesses (e.g., recesses 200, 205, 206, 207) are not provided in the inner surfaces of frames 13,14. In these instances, frame latches are provided adjacent to catch 70 so as to help retain male mullion reinforcement member 40 and female mullion reinforcement member 41 in place between frames 13,14. Each frame latch comprises a cantilevered beam 194 and an outwardly facing hook 196. When assembled to frames 13,14, hooks 196 engages tabs 19 located at the end of the inner surfaces of male mullion reinforcement member 40 and female mullion reinforcement member 41.

It is to be understood that the present invention is by no means limited only to the particular constructions herein disclosed and shown in the drawings, but also comprises any modifications or equivalents within the scope of the claims.

What is claimed is:

1. A mullion reinforcement for use in forming an assembly of windows comprising:

a first member, fastenable to a portion of a first window frame, including at least one pilot formed on a surface of said first member and a first portion of a latch and a first portion of a catch; and a second member, fastenable to a portion of a second window frame, including at least one pilot receptacle formed on a surface of said second member and engagable with said at least one pilot when said first window frame is assembled to said second window frame, said second member comprising a second portion of a latch and a second portion of a catch that are complementary to said first portion of a latch and said first portion of a catch so that when said first window frame is assembled to said second window frame said first member and said second member cooperate to form a latch and a catch.

2. A mullion reinforcement according to claim 1 wherein said at least one pilot comprises a tab projecting outwardly from said surface of said first member and said at least one pilot receptacle comprises a profile that is complementary to said tab.

3. A mullion reinforcement according to claim 2 wherein said first member includes a first portion of a latch and said second member includes a second portion of said latch that is complementary to said first portion so that when said first window frame is assembled to said second window frame said first member and said second member cooperate to form said latch.

4. A mullion reinforcement according to claim 2 wherein said first member includes a first portion of a second latch and said second member includes a portion of said second latch that is complementary to said portion of said second latch so that when said first window frame is assembled to said second window frame said first member and said second member cooperate to form a pair of latches.

5. A mullion reinforcement according to claim 1 wherein said latch and said catch am arranged in spaced apart relation to one another.

6. A mullion reinforcement according to claim 1 wherein said latch and said catch each comprise a pair of confronting cantilever beams.

7. A mullion reinforcement according to claim 1 wherein said catch is positioned between a pair of spaced apart said cantilever beams.

8. A mullion reinforcement according to claim 7 wherein each of said spaced apart cantilever beams includes an outwardly projecting portion that is sized and shaped so as to engage a confronting portion of at least one of said first and second window frames.

9. A mullion reinforcement according to claim 1 wherein each of said first portion of said latch and said second portion of said latch are U-shaped.

10. A window assembly including adjacent first and second windows each having a frame and being connected by a reinforcing mullion comprising, in combination:

(a) an elongated first window frame portion;

(b) an elongated second window frame portion; and (c) a mullion reinforcement comprising a first member, fastenable to said first window frame portion, and including at least one pilot formed on a surface of said first member and facing outwardly of said first window frame portion, and a first portion of a latch and a first portion of a catch; and a second member, fastenable to second window frame portion and including at least one pilot receptacle farmed on a surface of said second member and facing outwardly of said second window frame portion and engagable with said at least one pilot when said first window frame portion is assembled to said second window frame portion so as to form said window assembly, said second member including a second portion of a catch and a second portion of a latch that are complementary to said first portion of a latch and said first portion of a catch so that when said first window frame is assembled to said second frame said first member and said second member cooperate to form a latch and a catch.

11. A window assembly according to claim 10 wherein said at least one pilot comprises a tab projecting outwardly from said surface of said first member and said at least one pilot receptacle comprises a profile that is complementary to said tab.

12. A window assembly according to claim 10 wherein said catch is positioned between a pair of spaced apart said cantilever beams.

13. A window assembly according to claim 12 wherein each of said spaced apart cantilever beams includes an outwardly projecting hook portion that is sized and shaped so as to engage a portion of at least one of said first and second window frames.

14. A window assembly according to claim 12 further comprising a thermal barrier securely fastened to said latch wherein said thermal barrier comprises a channeled cross-section having a web and a pair of spaced apart flanges with a first catch projecting outwardly from said web so as to be positioned between said flanges and engaged with said latch and a second catch projecting outwardly from said web so as to be positioned away from said flanges.

15. A window assembly according to claim 14 wherein said first and second portions of a catch comprise a substantially triangular cross-sectional shape.

16. A window assembly according to claim 14 wherein said thermal barrier further includes insulating flanges that project outwardly from an intersection between said web and said pair of spaced apart flanges in substantially parallel relation to said web.

17. A window assembly according to claim 14 further comprising an exterior cover securely fastened to said thermal barrier wherein said exterior cover comprises an insulating channel including a web and spaced apart flanges wherein said spaced apart flanges include inwardly projecting shoulders positioned at a terminal end that are engageble with said second catch.

18. A window assembly according to claim 14 further comprising an interior cover comprising a channel-shaped cross-section having a web and spaced apart and a pair of spaced apart latching flanges that project outwardly from said web in substantially parallel relation to one another wherein each of said latching flanges includes inwardly projecting shoulders positioned at a terminal end and adapted to engage said latch.

19. A mullion reinforcement for use in forming an assembly of windows comprising:

a first member having a first end and a second end, and fastenable to a portion of a first window frame, including one elongate piloting tab extending along and projecting outwardly from a surface of said first member, a first portion of a latch positioned at said first end and a first portion of a catch positioned at said second end; and a second member having a first and a second end, and fastenable to a portion of a second window frame, including one elongate piloting receptacle formed on a surface of said second member, having a profile that is complementary to said piloting tab, and engagable with said one piloting tab when said first window frame is assembled to said second window frame and a second portion of a latch positioned at said second member first end and a second portion of a catch positioned at said second member second end so that when said first window frame is assembled to said second window frame said first member and said second member cooperate to form a latch and a catch.

20. A mullion reinforcement for use in forming an assembly of windows comprising:

a first member, fastenable to a portion of a first window frame, including;

at least one pilot formed on a surface of said first member;

a first portion of a latch;

a first portion of a catch; and a second member, fasten able to a portion of a second window frame, including at least one pilot receptacle formed on a surface of said second member and engagable with said at least one pilot when said first window frame is assembled to said second window frame wherein said second member includes a second portion of a latch that is complementary to said first portion of a latch so that when said first window frame is assembled to said second frame said first member and said second member cooperate to form a latch and further wherein said second member includes a second portion of a catch that is complementary to said first portion of a catch so that when said first window frame is assembled to said second window frame said first member and said second member cooperate to form a catch.

* * * * *